US010239332B2

(12) United States Patent
Nagaoka

(10) Patent No.: US 10,239,332 B2
(45) Date of Patent: Mar. 26, 2019

(54) PRINTER, AND PRINTER CONTROL METHOD

(71) Applicant: SEIKO EPSON CORPORATION, Tokyo (JP)

(72) Inventor: Minoru Nagaoka, Yamagata-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/709,226

(22) Filed: Sep. 19, 2017

(65) Prior Publication Data

US 2018/0079231 A1 Mar. 22, 2018

(30) Foreign Application Priority Data

Sep. 21, 2016 (JP) ..... 2016-183848

(51) Int. Cl.

| | |
|---|---|
| ***B26D 3/12*** | (2006.01) |
| ***B26D 5/00*** | (2006.01) |
| ***B26D 7/00*** | (2006.01) |
| ***B41J 11/00*** | (2006.01) |
| ***B41J 11/66*** | (2006.01) |
| ***B41J 11/70*** | (2006.01) |
| ***B41J 13/00*** | (2006.01) |
| ***B41J 3/407*** | (2006.01) |

(52) U.S. Cl.

CPC ..... *B41J 11/663* (2013.01); *B26D 5/007* (2013.01); *B41J 3/4075* (2013.01); *B41J 11/0095* (2013.01); *B41J 11/70* (2013.01); *B41J 13/0027* (2013.01); *B26D 3/12* (2013.01); *B26D 2007/005* (2013.01)

(58) Field of Classification Search

CPC .. B41J 11/663; B41J 13/0027; B41J 11/0095; B41J 3/4078

See application file for complete search history.

(56) References Cited

U.S. PATENT DOCUMENTS

| | | | |
|---|---|---|---|
| 5,531,530 | A | 7/1996 | Kuramoto et al. |
| 2008/0290578 | A1 | 11/2008 | Ebihara |
| 2010/0032466 | A1 | 2/2010 | Nishimura et al. |

(Continued)

FOREIGN PATENT DOCUMENTS

| | | | |
|---|---|---|---|
| JP | 07-172009 | A | 7/1995 |
| JP | 2002-172828 | A | 6/2002 |

(Continued)

OTHER PUBLICATIONS

Extended European Search Report dated Feb. 8, 2018 in related European Appl. No. 17192218.0 (9 pgs.).

*Primary Examiner* — Julian D Huffman

(74) *Attorney, Agent, or Firm* — Foley & Lardner LLP

(57) ABSTRACT

A printing device interrupts printing a label and cutting the label of which printing was interrupted when the image printed on the label may be corrupted. The printer controller drives a printhead and conveyance unit to print labels. When the trailing end of the label paper is detected, whether or not a target label in the group of labels being printed can be conveyed so that the trailing end of said target label goes downstream from the printing position before the conveyance amount of the conveyance unit reaches a specific amount. If said conveyance is not possible, printing the target label by the printhead is interrupted, the conveyance unit is controlled to set the target label being printed to the cutting position, and the cutter mechanism is then controlled to cut the target label.

8 Claims, 4 Drawing Sheets

(56) References Cited

U.S. PATENT DOCUMENTS

| | | | |
|---|---|---|---|
| 2012/0236075 | A1 | 9/2012 | Ito |
| 2013/0044151 | A1 | 2/2013 | Masuda et al. |
| 2015/0091966 | A1 | 4/2015 | Nagaoka |

FOREIGN PATENT DOCUMENTS

| | | | |
|---|---|---|---|
| JP | 2007-182085 | A | 7/2007 |
| JP | 2008-284840 | A | 11/2008 |
| JP | 2014-008741 | A | 1/2014 |

PRINTER, AND PRINTER CONTROL METHOD

BACKGROUND

The present disclosure relates to a printer that prints on label paper, and to a control method of the printer.

Printers that print on label paper having peelable labels affixed at a regular interval to a continuous web typically have a printhead, a conveyance unit for conveying the label paper through a conveyance path passing the printing position of the printhead and a cutter mechanism for cutting the label paper. The conveyance unit has a nip mechanism such as a pair of conveyance rollers that grip and convey the label paper on the upstream side of the printing position in the conveyance direction. The printer controls driving the conveyance unit and printhead to print labels as they pass the printing position. The cutter mechanism cuts the label paper on the conveyance path at a position downstream in the conveyance direction from the printing position.

When the trailing end of the label paper passes the nip position of the nip mechanism in such a printer, stably conveying the label paper by the conveyance unit is no longer possible. More specifically, once the trailing end of the label paper leaves the nip mechanism, the label paper may rise away from the conveyance path, causing the distance between the printhead and label to change. If the distance between the printhead and label inconsistent, images printed on the labels may become corrupted.

JP-A-H7-172009 describes technology that makes the printed image unusable when the printed image is corrupted in a printer that prints to a continuous recording medium. The printer described in JP-A-H7-172009 has a scanner and then a cutter mechanism disposed in sequence on the downstream side of the printhead in the conveyance direction. When a symbol such as a barcode is included in the print image, the printed image is read by the scanner and decoded, and corruption of the print image is determined based on the decoded information. If the printer determines the image is corrupted, the printer makes a cut in the printed paper.

SUMMARY

When the image printed on a label is corrupted in a printer that prints to label paper, the label on which the print image was printed may also be unusable. However, to use the technology of JP-A-H7-172009 to determine if the print image is corrupted, the printer must have a scanner. Furthermore, because the technology of JP-A-H7-172009 relies on a scanner located downstream from the printing position to determine if the print image is corrupted, depending on the relationship between the distance from the printing position to the detection position, and the distance between the labels on the label paper, printing the next label may have already started when the image corruption decision is made, and ink may be unnecessarily consumed (wasted).

The present disclosure is directed to this problem, and provides printer, and a control method of a printer, that interrupt printing the label when the image printed on a label may become corrupted as a result of being unable to convey the label paper with a consistent gap to the printhead.

a printer according to one embodiment includes a printhead; a conveyance unit configured to convey label paper having peelable labels affixed to a continuous liner, through a conveyance path passing a printing position of the printhead, and having a nip mechanism configured to nip the label paper at a nipping position upstream in the conveyance direction from the printing position on the conveyance path; a trailing end sensor configured to detect the trailing end of the label paper at a detection position set on the conveyance path upstream in the conveyance direction from the nipping position; a label sensor configured to detect the position of the label on the label paper; a cutter mechanism configured to cut the label paper at a cutting position set on the conveyance path on the downstream side in the conveyance direction from the printing position; and a controller configured to determine, when the trailing end of the label paper is detected, if the end of a target label on the upstream side in the conveyance direction in a group of labels being printed can be conveyed to the downstream side of the printing position before the conveyance distance by the conveyance unit reaches a specific amount, and if said conveyance is determined not possible, controls the printhead to interrupt printing to the target label, controls the conveyance unit after interrupting printing to set the target label to the cutting positions and controls the cutter mechanism to cut the target label.

This aspect of the embodiment interrupts printing by the printhead when the trailing end of label paper is detected and the upstream end the target label cannot be conveyed to the downstream side before the conveyance amount by the conveyance unit reaches a specific amount. In other words, when the trailing end of the label paper is conveyed a specific amount from when it was detected on the conveyance path, printing by the printhead is interrupted when the label paper may escape being nipped by the conveyance unit and stably conveying the label paper becomes not possible. Therefore, when corruption of the image printed on the target label is possible, completing printing to the target label and thereby wasting ink can be prevented. In addition, when printing to the target label is interrupted, the target label is set to the cutting position and cut. Mistakenly using a label on which the print image may be corrupted can be prevented.

Preferably, in the embodiment, said determination is based on the printable page length of the target label on the upstream side of the printing position when the trailing end of the label paper was detected.

When the trailing end of the label paper conveyed on the conveyance path has past through the nipping position of the nip mechanism, the label paper may rise away from the conveyance path and stable conveyance of the label paper by the conveyance unit may not be possible. The possibility of corruption of the image printed on the target label therefore increases. As a result, if the specific amount is set based on the distance between the nip position and the trailing end sensor, printing the target label can be interrupted when the possibility of corruption of the image printed on the target label is high.

A printer according to another aspect of the embodiment also has storage configured to store a label interval of the label paper; the controller determining, when said conveyance is determined not possible, whether or not the previously set target cutting position of the label paper is upstream from the cutting position, and if the set target cutting position is determined to be upstream from the cutting position, conveys the label paper and sets the target cutting position of the target label to the cutting position based on the position of the target label on the conveyance path when the trailing end of the label paper was detected, and a distance based on the label interval.

This configuration enables cutting the target label at a specific position (target cutting position). The label interval in this instance is the distance in the conveyance direction between the leading end of the first label and the leading end of the adjacent following label on the continuous web.

In another aspect of the embodiment, the controller determines, when said conveyance is determined not possible, whether or not the previously set target cutting position of the label paper is upstream from the cutting position; and if the set target cutting position is determined to not be upstream from the cutting position, stops conveying the label paper and cuts the label paper with the cutter mechanism.

This configuration simplifies the controller controlling positioning the target label to the cutting position.

Another aspect of the embodiment is a control method of a printer including a printhead; a conveyance unit configured to convey label paper having peelable labels affixed to a continuous liner through a conveyance path passing a printing position of the printhead, and having a nip mechanism configured to nip the label paper at a nipping position upstream in the conveyance direction from the printing position on the conveyance path; a trailing end sensor configured to detect the trailing end of the label paper at a detection position set on the conveyance path upstream in the conveyance direction from the nipping position; a label sensor configured to detect the position of the label on the label paper; a cutter mechanism configured to cut the label paper at a cutting position set on the conveyance path on the downstream side in the conveyance direction from the printing position; and including steps of: when the trailing end of the label paper is detected, if the end of a target label on the upstream side in the conveyance direction in a group of labels being printed can be conveyed to the downstream side of e printing position before the conveyance distance by the conveyance unit reaches a specific amount, and if said conveyance is determined not possible, interrupting printing to the target label by the printhead, after interrupting printing, setting the target label to the cutting position by the conveyance unit, and cutting the target label by the cutter mechanism after setting the target label to the cutting position.

This aspect of the embodiment interrupts printing on the target label when corruption of the image printed on the target label is possible, such as when stably conveying the label paper is not possible if the label paper is conveyed a specific amount after the trailing end of the label paper is detected on the conveyance path. Therefore when corruption of the image printed on the target label is possible, completing printing to the target label and thereby wasting ink can be prevented. In addition, when printing to the target label is interrupted, the target label is set to the cutting position and cut. Mistakenly using a label on which the print image may be corrupted can therefore be prevented.

In another aspect of the embodiment, said determination is based on the printable page length of the target label on the upstream side of the printing position when the trailing end of the label paper was detected.

When the trailing end of the label paper conveyed on the conveyance path has past through the nipping position of the nip mechanism, the label paper may rise away from the conveyance path and stable conveyance the label paper by the conveyance unit may not be possible. The possibility of corruption of the image printed on the target label therefore increases. As a result, if the specific amount is set based on the distance between the nip position and the trailing end sensor, print in the target label can be interrupted when the possibility of corruption of the image printed on the target label is high.

In another aspect of the embodiment, the control method of a printer further includes previously storing the label interval of the label paper; determining, when said conveyance is determined not possible, whether or not the previously set target cutting position of the label paper is upstream from the cutting position, and if the set target cutting position is determined to be upstream from the cutting position, conveys conveying the label paper based on the position of the target label on the conveyance path when the trailing end of the label paper was detected, and a distance based on the label interval; and setting the target cutting position of the target label to the cutting position.

This configuration enables cutting at a specific position (target cutting position) on the target label.

In another aspect of the embodiment, the control method of a printer further includes: determining, when said conveyance is determined not possible, whether or not the previously set target cutting position of the label paper is upstream from the cutting position end if the set target cutting position is determined to not be upstream from the cutting position, stopping conveying the label paper, and cutting the label paper with the cutter mechanism.

This configuration simplifies controlling setting the target label to the cutting position.

Other objects and attainments together with a fuller understanding of the invention will become apparent and appreciated by referring to the following description and claims taken in conjunction with the accompanying drawings.

DESCRIPTION OF EMBODIMENTS

Embodiments of a printer according to the present invention is ascribed below with reference to the accompanying figures.

General Configuration

Figure 1:
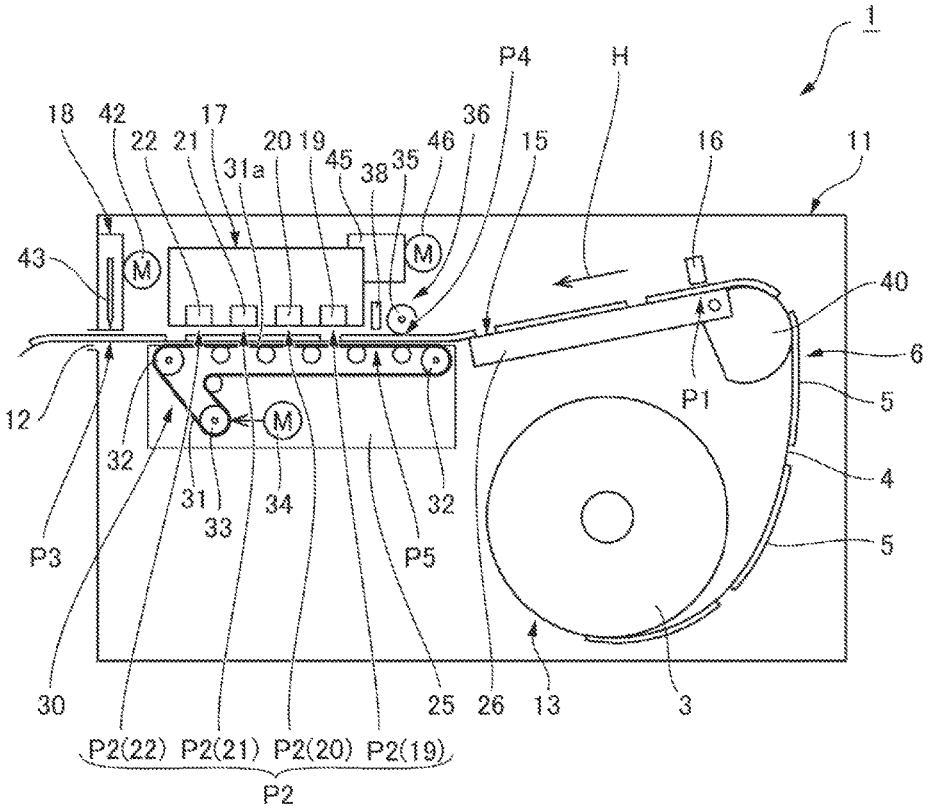
FIG. 1 schematically illustrates example of a printer according to the invention.

FIG. 1 schematically illustrates an example of a printer according to one embodiment of the invention. The printer 1 (printing device) in this example is a label printer that prints on label paper 6 that is delivered from a paper roll 3 and has labels 5 peelably affixed at a specific interval to a continuous liner 4.

The printer 1 has a paper exit 12 in the front of the printer case 11 from which the label paper 6 is discharged. A roll paper compartment 13 in which the paper roll 3 is held so that it can roll is disposed in the back bottom part of the printer case 11. Also inside the printer case 11 is a conveyance path 15 that guides the label paper 6 from the roll paper compartment 13 to the paper exit 12. The conveyance path 15 passes the trailing end detection position P1 of a trailing end sensor 16, the printing position P2 of the printhead 17, and the cutting position P3 of the cutter mechanism 18.

The conveyance path 15 is defined by a platen 25 disposed below the print head 17 with a specific gap therebetween, and a paper guide member 26 on the upstream side of the platen 25 and above the roll paper compartment 13.

The trailing end detection position P1 is set to the conveyance path portion defined by the paper guide member 26. The trailing end sensor 16 optically or mechanically detects change from the state in which the label paper 6 is present at the trailing end detection position P1, to the state in which the label paper 6 is not present.

The printing position 2 is defined by the top surface of the platen 25.

The printhead 17 is an inkjet head unit configured with four inkjet line heads arrayed at a specific interval along the conveyance direction H of the label paper 6. The printhead 17 has a first inkjet head 19 that ejects black ink, a second inkjet head 20 that ejects cyan ink, a third inkjet head 21 that ejects magenta ink, and a fourth inkjet head 22 that ejects yellow ink, disposed in this order from the upstream side to the downstream side of the conveyance direction H.

The printing position P2 of the printhead 17 has a width corresponding to the distance from the printing position P2(19) of the first inkjet head 19 located at the upstream end, to the printing position P2(22) of the inkjet line head at the downstream end.

The platen 25 has a conveyance mechanism 30 (conveyance unit) for conveying the label paper 6 through the conveyance path 15. The conveyance mechanism 30 includes a conveyor belt 31, multiple guide rollers 32 on which the conveyor belt 31 is mounted, a belt drive roller 33 for driving the conveyor belt 31, and a conveyance motor 34 for driving the belt drive roller 13.

The conveyor belt 31 has a conveyor belt portion 31*a* extending horizontally through the conveyance path portion from printing position P2(19) to printing position P2(22) of the printhead 17. A pressure roller 35 is pushed from above to the conveyor belt portion 31*a* at the upstream end in the conveyance direction H. The pressure roller 35 and conveyor belt 31 configure a nip mechanism 36 that nips and conveys the label paper 6 with the conveyor belt 31. The nip position P4 of the nip mechanism 36 is near printing position P2, and between printing position P2 and trailing end detection position P1.

A label sensor 38 that detects labels 5 is disposed on the downstream side of the pressure roller 35. The label sensor 38 optically detects a black mark at a specific position relative to each affixed label 5. In this case, the value output from the label sensor 38 differs when the black mark is and is not present at the label detection position P5 of the label sensor 38. Note that the label sensor 38 is not limited to detecting a black mark. For example, the label sensor 38 may output different values to the controller 51 described below when part of a label 5 affixed to the liner 4 is at the label detection position P5, and when a gap between one label 5 and the next label 5 on the liner 4 is at the label detection position P5. The label detection position P5 is set between the printing position P2 and nip position P4, and close to the nip position P4.

A slack lever 40 that moves according to change in the tension on the label paper 6 conveyed through the conveyance path 15 is disposed at the back end (upstream end) of the paper guide member 26. The slack lever 40 is urged by a coil spring, for example, in the direction applying tension to the label paper 6. After being pulled up along the conveyance path 15, the label paper 6 travels around the slack lever 40 and curves to the front.

The cutter mechanism 18 drives the cutter knife 43 as driven by a cutter motor 42, and cuts the label paper 6. The cutting position P3 of the cutter mechanism 18 is near the paper exit 12. The cutter mechanism 18 may be configured to cut completely across the width of the label paper. Alternatively, the cutter mechanism 18 may be configured to make a partial cut, that is, cut across the width of the label paper 6 while leaving part of the label paper 6 uncut.

The printer 1 has a head moving mechanism 45 that moves the printhead 17 between the printing position opposite the conveyance path 15, and a retracted position removed from the conveyance path 15 in a direction perpendicular to the conveyance direction H.

The head moving mechanism 45 has a carriage that carries the printhead 17, a carriage guide rail, and a moving mechanism (all not shown) that moves the carriage along the carriage guide rail. The head moving mechanism 45 also has a carriage motor 46 as the drive source. The head moving mechanism 45, by driving the carriage motor 46 and moving the carriage along the carriage guide rail, moves the printhead 17 on the carriage between the printing position and the retracted position.

Control System

Figure 2:
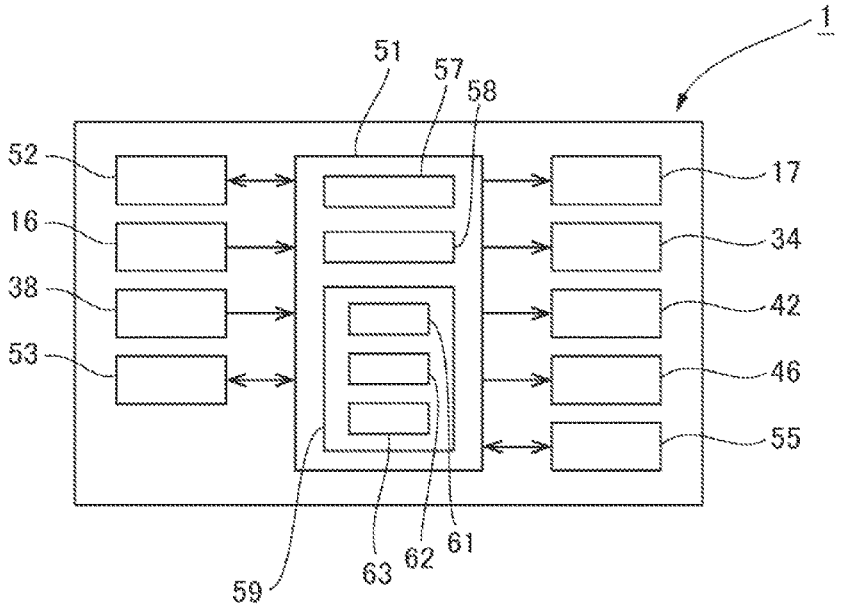
FIG. 2 is a block diagram of the control system of the printer in FIG. 1.

FIG. 2 is a block diagram of the control system of the printer in FIG. 1. As shown in FIG. 2, the printer 1 is configured around a controller 51 including a CPU. To the input side of the controller 51 are connected a communicator 52 communicatively connected to an external device, the trailing end sensor 16, the label sensor 38, and an input unit 53 such as a touch panel. Print data from an external device is input through the communicator 52 to the controller 51. Various settings are also input through the input unit 53 to the controller 51.

To the output side of the controller 51 are connected, through a driver not shown, the printhead 17, conveyance motor 34, cutter motor 42, and carriage motor 46. Storage 55 such as nonvolatile memory is also connected to the controller 51. Stored in the storage 55 is information such as the label interval, label length, and label gap of the label paper 6 used for printing. Also stored is information related to the specific position (target cutting position) where the target label 5T is to be cut in the cutting process described below.

The label interval is the distance in the conveyance direction H between the leading ends of two adjacent labels 5.

The label length is the length of each label 5 in the conveyance direction H, that is, the length from the leading end to the trailing end of each label 5.

The label gap is the distance between two adjacent labels 5 in the conveyance direction H, that is, the length in the conveyance direction H of the space where a label 5 is not affixed.

The label interval, label length, and label gap are input with the print data through the communicator 52 from an external device to the controller 51, and stored in the storage 55. The label interval, label length, label gap may also be input through the input unit 53 to the controller 51, and stored in the storage 55.

Figure 3:
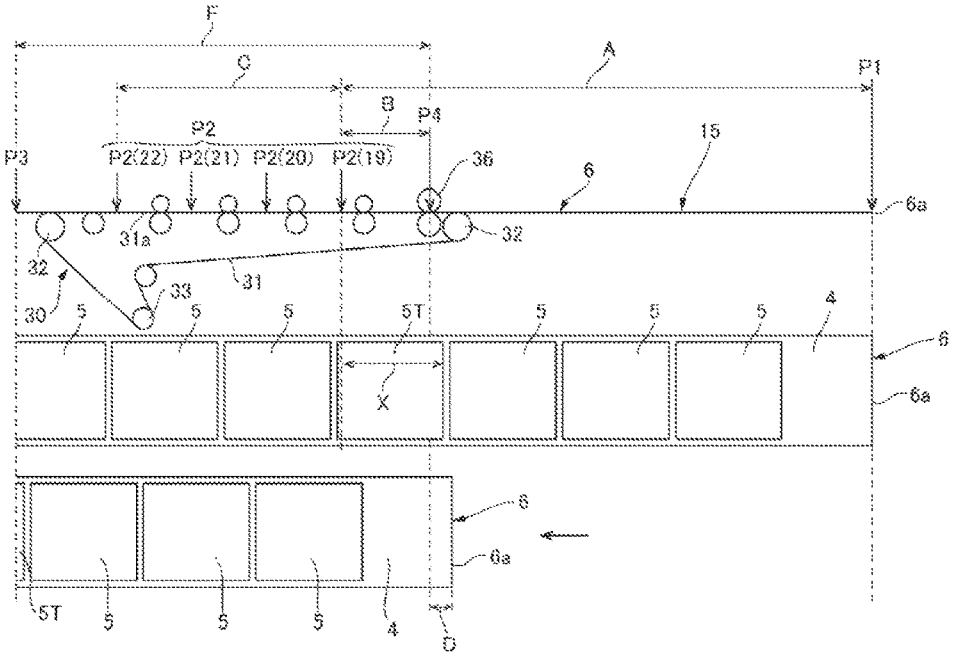
FIG. 3 describes the specific amount used to determine whether or not to interrupt the printing process.

When the output value of the trailing end sensor 16 to the controller 51 changes, the controller 51 determines, based on the chance in the output, that the trailing end sensor 16 detected the trailing end 6*a* of the label paper 6 see FIG. 3). More specifically, the controller 51 determines from the trailing end sensor 16 that the trailing end 6*a* of the label paper 6 reached and passed the trailing end detection position P1. Based on the change in the output when the output value output by the label sensor 38 to the controller 51 changes, the controller 51 detects the black mark corresponding to each label or the leading end of the label 5, and determines if the black mark or the leading end of the label 5 has reached and past the label detection position P5. Function blocks of the controller 51 include a label position acquisition unit 57, print controller 58, and trailing end processor 59.

When a label 5 is detected by the label sensor 38, the label position acquisition unit 57 acquires, based on the detection result, the position of the label 5 relative to the label detection position P5 on the conveyance path 15. More specifically, the label position acquisition unit 57 acquires the position of the leading end of the label 5 on the conveyance path 15 based on how much the conveyance motor 34 is driven after the label 5 is detected at the label detection position P5. Note that the position information detected by the label position acquisition unit 57 may be information about the position relative to another part. In this case, information related to the position of that other part relative to the label detection position P5 is previously stored in the storage 55.

The print controller 58 executes the printing process when print data is received from an external device. In the printing process the print controller 58 sets the printhead 17 to the printing position. The print controller 58 also controls driving the conveyance motor 34 to convey the label paper 6 at a constant speed by the conveyance mechanism 30. As each label 5 passes the printing position P2, the print controller 58 also controls driving the printhead 17 to print the print data on the label 5 passing the printing position P2 based on the positioning information of the label 5 on the conveyance path 15 acquired by the label position acquisition unit 57. If a cut command for cutting the label paper 6 is included in the print data, the print controller 5 controls driving the conveyance motor 34 based on the cut command to convey the label paper 6 by the conveyance mechanism 30 to position the target cutting position on the label paper 6 to the cutting position P3. When the cutting position on the label paper 6 is at the cutting position P3, the print controller 58 drives the cutter motor 42 to cut the label paper 6 with the cutter mechanism 18.

When the trailing end sensor 16 detects the trailing end of the label paper 6, the trailing end processor 59 determines whether or not normal printing can be completed on the target label 5T, which is located farthest upstream in the group of labels 5 being printed. More specifically, the trailing end processor 59 determines if the label paper 6 will be nipped by the nip mechanism 36 until printing is completed. If the label paper 6 will not be nipped by the nip mechanism 36 until printing the target label 5T is completed, printing the target label 5T is interrupted. After interrupting printing the target label 5T, the trailing end processor 89 sets the target label 5T to the cutting position P3. The trailing end processor 59 also drives the cutter motor 42 to cut the target label 5T at the cutting position P3. After cutting the target label 5T, the trailing end processor 59 drives the conveyance motor 34 to execute the discharge process of driving the conveyance motor 34 to discharge the trailing end portion of the label paper 6 on the conveyance path 15 from the paper exit 12.

However, if the label paper 6 will be nipped by the nip mechanism 36 until printing the target label 5T is completed, the trailing end processor 59 continues printing the target label 5T by the print controller 58 and completes printing. The trailing end processor 59 then executes the discharge process.

When the trailing end 6*a* of the label paper 6 being conveyed separates from the nip mechanism 36, the label paper 6 may rise away from the conveyance path 15 (the top of the platen 25). If the label paper 6 rises, the distance between the printhead 17 and label 5 changes. If the distance between the printhead 17 and label 5 changes, placement of the ink on the label 5 will vary, and the likelihood of the image printed on the label 5 being corrupted increases. The trailing end processor 59 therefore stops operation of the printhead 17, and interrupts printing on the target label 5T for which the possibility of being unable to complete printing normally, that is, for which the likelihood of the print image being corrupted, is high. The trailing end processor 59 also cuts the target label 5T on which the print image may be corrupted, making the target label 5T unusable.

Note that the trailing end processor 59 drives the carriage motor 46 to start moving the printhead 17 to the retracted position before driving the cutter motor 42. For example, if it is determined that printing to the target label 5T cannot be completed normally and the target label 5T is cut at the cutting position P3, the trailing end processor 59 conveys the target label 5T to the cutting position P3, and then stops driving the conveyance motor 34 and stops conveying the label paper 6. The trailing end processor 59 then drives the carriage motor 46 and moves the printhead 17 to the retracted position before the cutter motor 42 is driven in the cutting process to out the label 5 for which conveyance was stopped. Throughput is thus improved because the label paper 6 is cut by the cutter mechanism 18 while the printhead 17 is moving to the retracted position, moving the printhead to the retracted position takes a long time to complete.

Preferably, the carriage motor 46 is driven to start moving the printhead 17 to the retracted position before the paper discharge process of the print controller trailing end processor 59. For example, even if it is determined that printing the target label 5T can be normally completed, the print controller 58 stops the conveyance motor 34 and stops conveying the label paper 6 after completing printing, and therefore preferably drives the carriage motor 46 after stopping conveying the label paper 6. The trailing end processor 59 moves the printhead 17 to the retracted position before the discharge process to prevent the menisci in the ink nozzles of the printhead 17 from breaking due to the trailing end 6*a* of the label paper 6 separating from the platen 25 and contacting the printhead 17, or the tape attaching the trailing end 6*a* of the label paper 6 to the tube of the paper roll 3 contacting the printhead 17, when the trailing end of the label paper 6 is discharged from the paper exit 12.

The trailing end processor 59 includes an interruption decision unit 61, interruption processor 62, and printing completion processor 63.

When the trailing end sensor 16 detects the trailing end 6*a* of the label paper 6, the interruption decision unit 61 determines whether or not printing the target label 5T can be completed normally. More specifically, the interruption decision unit 61 determines if the trailing end of the target label 5T on the conveyance path 15 can be conveyed to the downstream side of the printing position P2 (printing position P2(22)) before the conveyance amount of the conveyance mechanism 30 reaches a specific amount N. This amount N is the length of label paper 6 that can be conveyed with the label paper 6 reliably nipped by the nip mechanism 36 after the trailing end sensor 16 detects the trailing end 6*a* of the label paper 6. In other words, this amount N is the length of label paper 6 that can be conveyed stably after the trailing end sensor 16 detects the trailing end 6*a* of the label paper 6.

FIG. 3 describes the method of setting amount N. The relative positions of the trailing end detection position P1, printing position P2, cutting position P3, and nip position P4 on the conveyance path 15 are shown on the top row in FIG. 3.

The position of the label paper 6 on the conveyance path 15 when the trailing end 6*a* of the label paper 6 is detected at the trailing end detection position P1 is shown in the middle in FIG. 3.

The position of the label paper 6 when conveyance is stopped where the end of the label paper 6 will not lift away from the conveyance path 15 (the top of the platen 23) shown on the bottom in FIG. 3.

In the middle in FIG. 3, three labels 5 are in the process of being printed. The target label 5T is the label that is farthest upstream in this group of labels 5. In the example in FIG. 3, printing target label 5T has already started when the trailing end 6*a* of the label paper 6 is detected.

As shown in FIG. 3, specific amount N is set based on the distance A between the printing position P2 (printing position P2(19)) and trailing end detection position P1; the distance B between the printing position P2 (printing position P2(19)) and nip position P4; and buffer length D allowing for conveyance error and the paper remainder when label paper 6 conveyance stops.

Specific amount N is calculated using equation (1).

$$N=A-B-D \tag{1}$$

As shown on the bottom in FIG. 3, buffer length D is the length of paper required for the nip mechanism 36 to reliably nip the trailing end 6*a* of the label paper 6 when the conveyance motor 34 stops and label paper 6 conveyance stops. If this length is assured when label paper 6 conveyance stops, the chance of the trailing end 6*a* separating from the nip mechanism 36 due to conveyance error or detection deviations when label paper 6 conveyance stops can be reduced. As a result, the menisci in the ink nozzles of the printhead 17 can therefore be prevented from being broken by the trailing end 6*a* of the label paper 6 separating from the platen 25 and contacting the printhead 17, or the tape attaching the trailing end 6*a* of the label paper 6 to the tube of the paper roll 3 contacting the printhead 17.

The distance A between the printing position P2 and trailing end detection position P1 is greater than the distance F between the nip position P4 and cutting position P3. In other words, as described below, the printer of the embodiment conditionally cuts the target label 5T with the cutter mechanism 18. When the cutter mechanism 18 cuts the label paper 6, some part of the label paper 6 is preferably nipped by the nip mechanism 36. As a result, a configuration in which the trailing end 6*a* is upstream from the nip position P4 until the label paper 6 that is at the printing position P2(19) when the trailing end 6*a* is detected is conveyed to the cutting position P3 is preferable.

The conveyance distance M from where the trailing end sensor 16 detects the trailing end 6*a* of the label paper 6 until printing the target label 5T is completed is calculated from equation (2). More specifically, the conveyance distance required to convey the target label 5T to the downstream side of the printing position P2 (printing position P2(22)) is calculated from equation (2) based on the printable page length X of the target label 5T when the trailing end sensor 16 detects the trailing end 6*a* of the label paper 6; the width C of the printing position P2 in the conveyance direction H (the distance from printing position P2(19) to printing position P2(22)); and the distance required to stop the conveyance motor 34 after printing ends (that is, the deceleration distance E the label paper 6 is conveyed while the conveyance motor 34 decelerates).

$$M=X+C+E \tag{2}$$

The printable page length X of the target label 5T is the length of the portion of the target label 5T upstream from the printing position P2 (printing position P2(19)). The printable page length X can be acquired based on the position of the target label 5T on the conveyance path 15, and the label length. For example, the printable page length X can be acquired by subtracting the distance between the position of the leading end of the target label 5T and the printing position P2 (printing position P2(19)) from the label length.

Note that to determine if printing the target label 5T can be normally completed, the trailing end 6*a* is not conveyed to the printing position P2 in this example until the label paper 6 at the printing position P2(19) when the trailing end 6*a* of the label paper 6 is detected at least passes all of the inkjet heads 19.

The configuration of this embodiment of the invention therefore satisfies the condition defined in equation (3).

$$A-B>C \tag{3}$$

If the conveyance distance M until printing the target label 5T ends is less than or canal to specific amount N (if M<=N), the trailing end of the target label 5T can be conveyed to the downstream side of the printing position P2 before the conveyance distance by the conveyance mechanism 30 reaches amount N. If equation (4) below true for the target label 5T, the interruption decision unit 61 determines that the trailing end of the target label 5T can be conveyed to the downstream side of the printing position P2 before the conveyance distance by the conveyance mechanism 30 reaches amount N. Furthermore, if equation (4) below is not true for the target label 5T for which printing started, the interruption decision unit 61 determines that the trailing end of the target label 5T cannot be conveyed to the downstream side of the printing position P2 before the conveyance distance the conveyance mechanism 30 reaches amount N.

$$X+C+E<=A-B-D \tag{4}$$

Equation (4) can be rewritten to leave only the printable page length X of the target label 5T on the left side, as shown in equation (5).

$$X<=A-B-C-D-E \tag{5}$$

Equation (5) means that if the label length of each label 5 on the label paper 6 is less than or equal to the value on the right side of equation (5), the trailing end of the target label 5T can always be conveyed to the downstream side of the printing position P2 before the conveyance distance by the conveyance mechanism 30 reaches amount N, and printing the target label 5T can be completed. Therefore, if the label length is X and equation (5) is true, the interruption decision unit 61 determines that the trailing end of the target label 5T can be conveyed to the downstream side of the printing position P2 before the conveyance distance by the conveyance mechanism 30 reaches amount N.

If the interruption decision unit 61 determines that the trailing end of the target label 5T cannot be conveyed to the downstream side of the printing position P2 before the conveyance distance by the conveyance mechanism 30 reaches amount N, the interruption processor 62 interrupts printing the target label 5T by the print controller 58, and executes the cutting process of the target label 5T by the cutter mechanism 18.

To cut the target label 5T, the interruption processor 62 conveys the target label 5T to the cutting position, then stops label paper 6 conveyance, drives the carriage motor 46 to move the printhead 17 to the retracted position, then executes the cutting process with the cutter mechanism 18, and discharges the paper. In the discharge process, the interruption processor 62 drives the conveyance motor 34 to discharge the trailing end of the label paper 6 remaining on the conveyance path 15 from the paper exit 12.

In the cutting process, the interruption processor 62 determines, based on distance between the cutting position P3 and the position of the target label 5T on the conveyance path 15 when the trailing end 6*a* of the label paper 6 was detected with the target label 5T at the cutting position P3, whether or not a specific position (target cutting position) on the target label 5T is on the upstream side of the cutting position P3. In this example, this specific position is 12.7 mm from the downstream end of the label 5. If this specific position is determined to be upstream from the cutting position P3, the conveyance motor 34 is driven to position the specific position of the target label 5T at the cutting position to the cutting position P3. After the target label 5T is set to the cutting position P3, the conveyance motor 34 stops.

Note that the specific position is not limited to 12.7 mm from the downstream end of the label 5, and may be a position determined according to the area that is printed instead of a length from an end of the target label 5T. This control method enables setting the place that is cut by the cutter mechanism 18 to a position easily recognized by the user, thereby reducing the possibility of the user mistakenly using the printed target label 5T.

Furthermore, if the interruption processor 62 determines the specific position is not located upstream from the cutting position P3, the interruption processor 62 interrupts printing and stops driving the conveyance motor 34 to stop conveying the label paper 6. When this decision is made, the target label 5T is located at the cutting position P3, and the target label 5T is then cut. If reverse conveyance is required to set the specific position to the cutting position P3, this control method cuts at a position other than the specific position, but avoids reducing throughput resulting from reversing the label paper 6.

If the interruption decision unit 61 determines the trailing end of the target label 5T can be conveyed to the downstream side of the printing position P2 before the conveyance amount reaches specific amount N when the trailing end sensor 16 detects the trailing end 6*a* of the label paper 6, the printing completion processor 63 continues printing the target label 5T with the print controller 58, and completes printing on the target label 5T. The printing completion processor 63 also stops driving the conveyance motor when printing the target label 5T ends, and stops conveying the label paper 6. The printing completion processor 63 then drives the carriage motor 46 to move the printhead 17 to the retracted position, and executes the discharge process. In the discharge process, the printing completion processor 63 drives the conveyance motor 34 and discharges the trailing end of the label paper 6 on the conveyance path 15.

Printing Process

Figure 4:
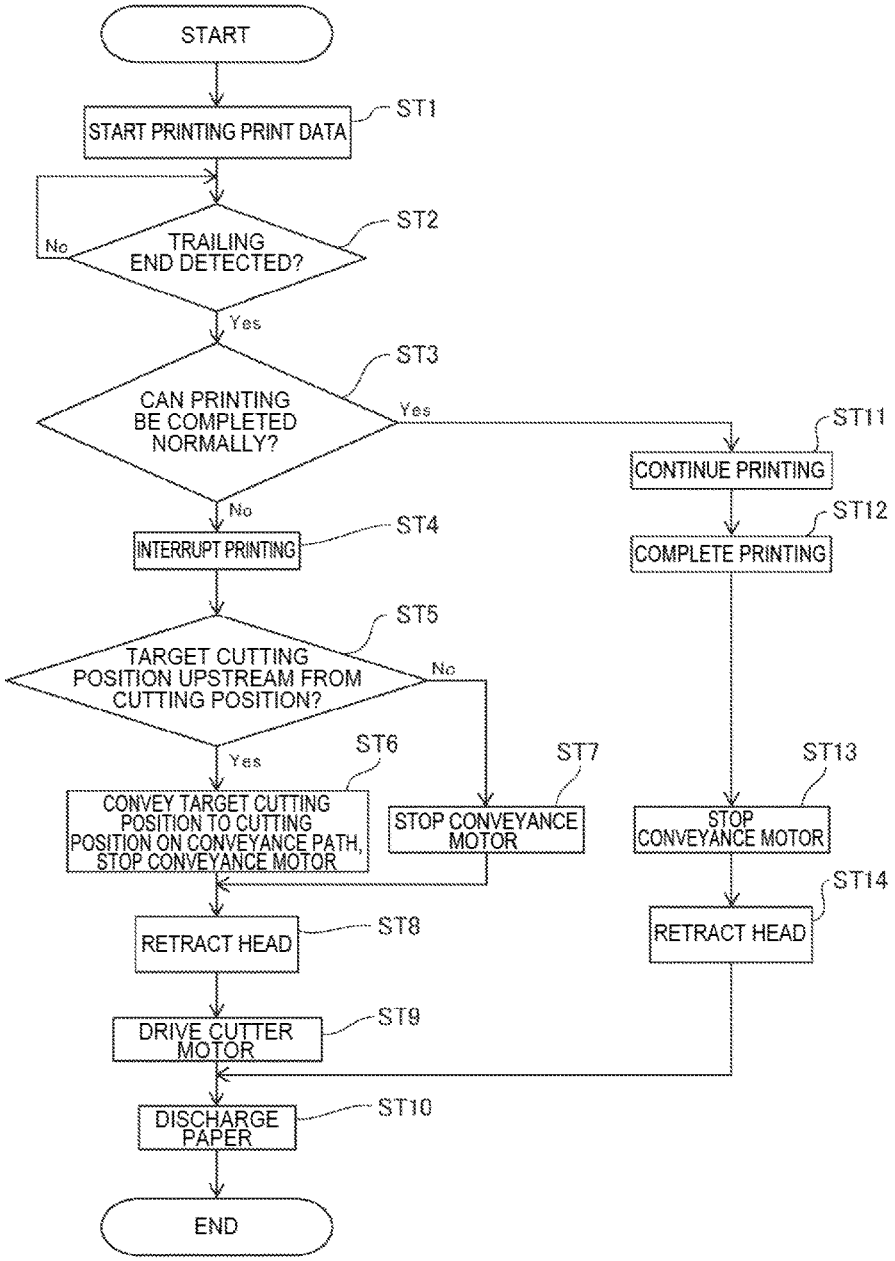
FIG. 4 is a flow chart of the printing process.
Figure 5:
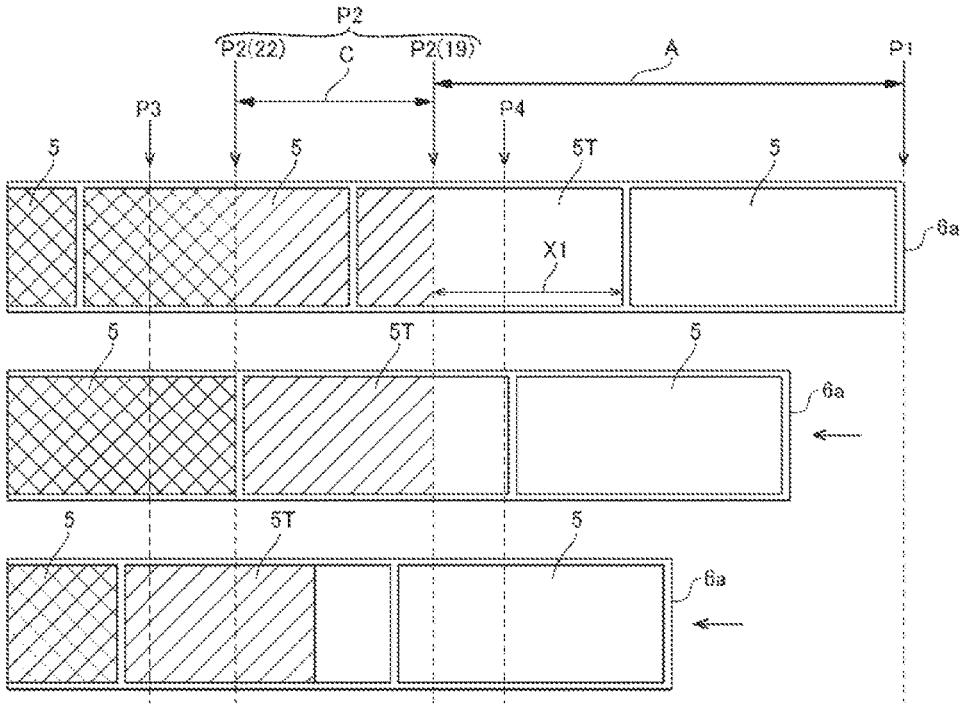
FIG. 5 describes interrupting printing on specific target label.

FIG. 4 is a flow chart of the printing operation of the printer 1. FIG. 5 describes the operation stopping printing to the target label 5T.

The location of the label paper 6 when the trailing end sensor 16 detects the trailing end 6*a* of the label paper 6 is shown on the top in FIG. 5. The location of the label paper 6 when printing to the target label 5T is interrupted is shown in the middle in FIG. 5. The location of the label paper 6 when the target label 5T is at the cutting position is shown on the bottom in FIG. 5. The checkered portion of intersecting lines on each label 5 in FIG. 5 denotes where printing has been completed; the portion shaded with only parallel diagonal lines denotes where labels 5 have been printed by only some of the inkjet heads; and the blank areas denote where nothing has been printed. The label interval, label length, and label gap of the label paper 6 loaded in the printer 1 are previously stored in the storage 55 of the printer 1.

When print data is supplied to the printer 1 from a host computer or other external device, the printer 1 starts the printing process. More specifically, the print controller 58 drives the conveyance motor 34 to start conveying the label paper 6 at a constant speed by the conveyance mechanism 30, and starts driving the printhead 17 to print the print data on each label 5 passing the printing position P2 (step ST1).

While printing, the controller 51 (interruption decision unit 61) monitors for the trailing end 6*a* of the label paper 6 by the trailing end sensor 16. When the trailing end sensor 16 detects the trailing end 6*a* of the label paper 6 (step ST2: Yes), the controller 51 (interruption decision unit 61) determines whether or not printing the target label 5T can be completed normally (step ST3).

In the example in FIG. 5, the printable page length X1 of the portion of the target label 5T on the upstream side of the printing position P2 (printing position P2(19)) when the trailing end 6*a* of the label paper 6 is detected does not satisfy equation (5). In this case, therefore, step ST3 determines that printing the target label 5T cannot be completed normally (step ST3: No).

When it is determined in step ST3 that printing the target label 5T cannot be completed normally (step ST3: No), the controller 51 (interruption processor 62) interrupts printing to the target label 5T (step ST4).

Note that the print controller 58 continues and completes printing any labels 5 being printed that are on the downstream side of the target label 5T. As shown in the middle in FIG. 5, printing the target label 5T is interrupted when printing the label 5 that is being printed and is on the downstream side of the target label 5T is completed.

The controller 51 (interruption processor 62) then executes the cutting process on the target label 5T for which printing was interrupted. In the cutting process, the controller 51 (interruption processor 62) determines if the target cutting position on the target label 5T is upstream from the cutting position P3 (step ST5). In the example in FIG. 5, as shown in the printing interruption figure, when printing is interrupted, the target label 5T has not been conveyed to the cutting portion P3, and the target cutting position is therefore determined to be upstream from the cutting position P3 (step ST5: Yes).

In step ST5, if the target cutting position is determined to be upstream from the cutting position P3 (step ST5 Yes), the conveyance motor 34 is driven to convey the target cutting position to the cutting position, and the conveyance motor is then stopped (step ST6). The bottom row in FIG. 5 shows the label paper 6 when step ST6 ends.

If in step ST5 the target cutting position is determined to not be upstream from the cutting position P3 (step ST5: No), the conveyance motor 34 stops when the decision is made (step ST7).

After the conveyance motor 34 stops in step ST6 or step ST7, the controller 51 drives the carriage motor 46 to start retracting the printhead 17 (step ST8). Next, the controller 51 (interruption processor 62) drives the cutter mechanism to cut the target label 5T (step ST9). Next, the controller 51 (interruption processor 62) executes the paper discharge process (step ST10).

If the printable page length X1 of the target label 5T satisfies equation (5) and it is determined that printing the target label 5T can be completed normally (step ST3: Yes), the controller 51 (printing completion processor 63) executes the process of completing printing to the target label 5T (step ST11 to step ST14). More specifically, the controller 51 (printing completion processor 63) continues printing to the target label 5T by the print controller 58 (step ST11), and finishes printing the target label 5T (step ST12).

Next, the controller 51 (printing completion processor 63) stops the conveyance motor from the time the printhead 17 is stopped, and stops conveying the label paper 6 (step ST13). The controller 51 (printing completion processor 63) then moves the printhead 17 to the retracted position (step ST14), and then goes to step ST10 to execute the discharge process. The operation from step ST10 is the same as when it is determined in step ST3 that printing normally to the target label 5T cannot be completed.

The process executed when it is determined in step ST3 that printing the target label 5T can be completed normally supposes a process in which the print data for the target label 5T does not include a cut command, but the print data may include a cut command. In this event, the decision of step ST3 determines whether or not the label paper 6 is nipped by the nip mechanism 36 until the part of the label paper 6 specified to be cut by the cut command is at the cutting position. More specifically, it is determined that printing to the target label 5T can be completed normally, and the label paper 6 can be cut normally based on the cut command, if, when the trailing end 6*a* is detected, the distance between the position specified by the cut command and the cutting position P3 is greater than the distance between the trailing end detection position P1 and nip position P4 minus the buffer length allowing for conveyance error.

Operating Effect

In this example, printing the target label 5T is interrupted if, when the trailing end 6*a* of the label paper 6 is detected, it determined that the trailing end of the target label 5T cannot be conveyed to the downstream side of the printing position P2 before the conveyance distance by the conveyance mechanism 30 reaches a specific amount N. In other words, printing the target label 5T is interrupted if the label paper 6 escapes nipping by the conveyance mechanism 30 and the label paper 6 cannot be conveyed stably when the trailing end 6*a* of the label paper 6 is conveyed distance N from when it was detected on the conveyance path 15. Therefore, when there is the possibility of the print image on the target label 5T being corrupted, finishing printing the target label 5T and wasting ink can be prevented.

Furthermore, when printing the target label 5T is interrupted, the target label 5T is set to the cutting position P3 and cut. Therefore, mistakenly using a target label 5T with a printed image that may be corrupted can be prevented.

Variations

When the controller 51 (interruption processor 62) positions the target label 5T to the cutting position P3, the label paper 6 may be conveyed the distance between the printing position P2 and cutting position P3 to set the target label 5T to the cutting position P3. This configuration simplifies control by the controller 51 setting the target label 5T to the cutting position P3.

In the example described above, the printhead 17 is retracted to the retracted position before the discharge process, but the discharge process may be executed without retracting the printhead 17. In this case, because the controller 51 (printing completion processor 63) must control stopping the conveyance motor 34 before the discharge process, there is no need to consider the deceleration distance E when setting the specific amount N. It is also not necessary to consider the remaining paper length and conveyance error D when stopping conveying the label paper 6.

While certain embodiments are described above, the invention is not limited thereto and it will be obvious that it may be varied in many ways. Such variations are not to be regarded as a departure from the spirit and scope of the invention, and all such modifications as would be obvious to one skilled in the art are intended to be included within the scope of the following claims.

This application claims priority under 35 U.S.C. § 119 to Japanese Patent Application No. 2016-183848, filed Sep. 21, 2016. The entire disclosure of Japanese Patent Application No. 2016-183848 is hereby incorporated herein by reference.

What is claimed is:

1. A printer comprising:

a printhead;

a conveyor configured to convey label paper having peelable labels affixed to a continuous liner through a conveyance path passing a printing position of the printhead, and having a nip mechanism configured to nip the label paper at a nipping position upstream in the conveyance direction from the printing position on the conveyance path;

a trailing end sensor configured to detect the trailing end of the label paper at a detection position set on the conveyance path upstream in the conveyance direction from the nipping position;

a label sensor configured to detect the position of the label on the label paper;

a cutter configured to cut the label paper at a cutting position set on the conveyance path on the downstream side in the conveyance direction from the printing position;

a controller configured to determine, when the trailing end of the label paper is detected, if the upstream side end of a target label being printed can be conveyed to the downstream side of the printing position before the conveyance distance by the conveyor reaches a specific amount, and if said conveyance is determined not possible, controls the printhead to interrupt printing to the target label, controls the conveyor after interrupting printing to set the target label to the cutting position, and controls the cutter to cut the target label; and storage configured to store a label interval of the label paper;

the controller determining, when said conveyance is determined not possible, whether or not the previously set target cutting position of the label paper is upstream from the cutting position, and if the set target cutting position is determined to be upstream from the cutting position, conveys the label paper and sets the target cutting position of the target label to the cutting position based on the position of the target label on the conveyance path when the trailing end of the label paper was detected, and a distance based on the label interval.

2. The printer described in claim 1, wherein:

said determination is based on the printable page length of the portion of the target label on the upstream side of the printing position when the trailing end of the label paper was detected.

3. The printer described in claim 1, wherein:

the specific amount is set based on conveyance error.

4. The printer described in claim 1, wherein:

the controller determines, when said conveyance is determined not possible, whether or not the previously set target cutting position of the label paper is upstream from the cutting position, and if the set target cutting position is determined to not be upstream from the cutting position, stops conveying the label paper and cuts the label paper with the cutter.

5. A control method of a printer including a printhead; a conveyor configured to convey label paper having peelable labels affixed to a continuous liner through a conveyance path passing a printing position of the printhead, and having a nip mechanism configured to nip the label paper at a nipping position upstream in the conveyance direction from the printing position on the conveyance path; a trailing end sensor configured to detect the trailing end of the label paper at a detection position set on the conveyance path upstream in the conveyance direction from the nipping position; a label sensor configured to detect the position of the label on the label paper; a cutter configured to cut the label paper at a cutting position set on the conveyance path on the downstream side in the conveyance direction from the printing position; and comprising steps of:

when the trailing end of the label paper is detected, determining if the upstream side end of a target label being printed can be conveyed to the downstream side of the printing position before the conveyance distance by the conveyor reaches a specific amount;

if said conveyance is determined not possible, interrupting printing to the target label by the printhead;

after interrupting printing, setting the target label to the cutting position by the conveyor;

cutting the target label by the cutter after setting the target label to the cutting position;

previously storing the label interval of the label paper;

determining, when said conveyance is determined not possible, whether or not the previously set target cutting position of the label paper is upstream from the cutting position, and if the set target cutting position is determined to be upstream from the cutting position, conveying the label paper based on the position of the target label on the conveyance path when the trailing end of the label paper was detected, and a distance based on the label interval; and setting the target cutting position of the target label to the cutting position.

6. The control method of a printer described in claim 5, wherein:

said determination is based on the printable page length of the portion of the target label on the upstream side of the printing position when the trailing end of the label paper was detected.

7. The control method of a printer described in claim 5, wherein:

the specific amount is set based on conveyance error.

8. The control method of a printer described in claim 5, further comprising:

determining, when said conveyance is determined not possible, whether or not the previously set target cutting position of the label paper is upstream from the cutting position, and if the set target cutting position is determined to not be upstream from the cutting position, stopping conveying the label paper, and cutting the label paper with the cutter.

* * * * *